US007509699B1

(12) United States Patent
Tresenfeld

(10) Patent No.: US 7,509,699 B1
(45) Date of Patent: Mar. 31, 2009

(54) LEVELING CAMPING PAD

(76) Inventor: Eugene Lee Tresenfeld, 523 Antelope Way, Eugene, OR (US) 97401

( * ) Notice: Subject to any disclaimer, the term of this patent is extended or adjusted under 35 U.S.C. 154(b) by 0 days.

(21) Appl. No.: 11/709,633

(22) Filed: Feb. 21, 2007

(51) Int. Cl.
*A47C 27/10* (2006.01)

(52) U.S. Cl. ..... 5/710; 5/413 AM; 5/420; 5/709

(58) Field of Classification Search ..... 5/420, 5/419, 417, 413 R, 413 AM, 710, 709
See application file for complete search history.

(56) References Cited

U.S. PATENT DOCUMENTS 1,324,009 A * 12/1919 Hope ..... 5/413 R
2,604,641 A * 7/1952 Reed ..... 5/710
3,428,974 A * 2/1969 Stuart ..... 5/710
4,962,553 A * 10/1990 Marquis ..... 5/710
5,044,030 A * 9/1991 Balaton ..... 5/710
5,553,339 A * 9/1996 Thomas ..... 5/413 AM
2007/0044236 A1 * 3/2007 Tatsuno ..... 5/420

* cited by examiner

*Primary Examiner*—Alexander Grosz
(74) *Attorney, Agent, or Firm*—Risto A. Rinne, Jr.

(57) ABSTRACT

An apparatus for placement under a sleeping bag useful in leveling or controlling the attitude of the sleeping bag includes a plurality of chambers, some of which extend along a longitudinal length of the leveling camping pad with respect to each other, and wherein some of which are adjacent to each other and extend along a width of the apparatus, and wherein the width is perpendicular with respect to the length, and wherein at least four of the plurality of chambers include a valve for adding or removing air from each of the chambers without affecting a quantity of air in the remaining chambers. A preferred modification includes a continuous upper chamber that extends over the plurality of chambers.

14 Claims, 4 Drawing Sheets

LEVELING CAMPING PAD

BACKGROUND OF THE INVENTION

1. Field of the Invention

The present invention, in general, relates to camping and, more particularly, to camping pads.

When camping, a lightweight pad or mattress is used under a sleeping bag. These devices are sometimes referred to as "sleeping pads", "camping pads", "camp pads", "camping mattresses", "camp mattresses", or "air mattresses". As used herein the term, "camping pad" is intended to refer to any such type of a mattress or pad that is intended for use under any type of sleeping bag. It is further understood that sleeping bags, in general, are used as a temporary type of bedding that is used, primarily, when camping in one form or another.

Camping pads fall into two general categories, either that variety which is inflatable or not inflatable. Those that are not inflatable are essentially closed-cell foam strips of a predetermined size. Because they tend to be heavier than inflatable types, their use is generally limited to stationary use, for example, to provide additional comfort to a bed at home. When these types of non-inflatable pads are used in any camping situation, it would typically be camping in the backyard or perhaps car camping. They are preferably not used when backpacking or whenever either size or weight is an issue.

The present invention appertains either to inflatable types of camping pads or non-inflatable types when the instant invention is included as well. There are two basic types of inflatable camping pads, both of which rely on a quantity of air for inflation during use and which deflate for portage.

A first, and generally older type of camping pad, is essentially an inflatable air mattress. A fill valve is opened and air is forced in under positive pressure by mouth, typically, to inflate the camping pad a desired amount.

A second, and generally newer type of camping pad, is a variation of the prior type that also includes an open-cell expandable type of foam filler therein. When a fill valve for such a type of camping pad is opened, the compressed foam (from the deflated state) begins to expand and naturally inflate the mattress.

The foam adds additional insulation value (i.e., insulation or "R" value) that is greater than if the pad were inflated only with air. Accordingly, these types of camping pads are generally regarded as being more comfortable than those which rely only on air as a filler material.

The second type of camping pad that includes the foam therein will automatically fill to a predetermined extent merely by the natural expansion of the foam therein. As the foam expands, a partial vacuum is created in the camping pad that draws outside air in through the fill valve.

For some users the quantity of air that is automatically drawn in is sufficient when combined with the resiliency of the foam and so these users merely close the valve when an equilibrium of pressures occurs inside and outside the camping pad. For other users who desire a firmer mattress, they use their mouth to blow a small additional quantity of air into the pad and then close the valve.

The camping pads that include the foam are generally regarded as being of superior design because they self-inflate (at least to a limited extent) and therefore are easier to use. Also, they tend to be warmer and therefore, more comfortable.

To deflate any type of inflatable camping pad, the fill valve is opened and the camping pad is rolled beginning at an end that is distal the fill valve toward the fill valve. As the camping pad is rolled, it is increasingly compressed. This forces air out of the fill valve until the bag is fully rolled at which time the fill valve is closed to prevent the reentry of additional air. If the camping pad also includes the open cell type of foam therein, the foam is also compressed during the rolling of the camping pad which forces air out of the foam and eventually out of the fill valve.

While these and perhaps other types of camping pads or mattresses have been used for a long time, they have certain disadvantages when used for camping. Whether backpacking into a remote camping spot or setting up a tent proximate an automobile, virtually all campers are aware of the rarity of a level place to pitch a tent or a sleeping bag if they are camping under the stars.

Campgrounds have a limited number of sites available for use. Knowledgeable campers arrive early and choose the most level sites. Those who arrive afterward must make do with what remains. When using backcountry camping sites, there are often either few or possibly no level spots from which to choose.

Inclines are the rule, not the exception, and the camper must try to find as level a spot as possible. If the camper is forced to sleep at incline, they may roll or otherwise gravitate downhill as they toss and turn during the night. They may even roll off of the camping pad.

There has heretofore been no known way to compensate for an incline with a camping pad and level a sleeping bag when car camping, backpacking, or mountain camping, etc, when the sleeping bag is placed atop the camping pad and the camping pad is placed on the ground, on a liner that is placed on the ground, or on a tent floor that is placed on the ground if the surface is inclined.

A second problem is that if by chance the surface is generally level, it may include bumps and dips in the terrain. A rise (i.e., a swell) under the back of a person can make sleeping uncomfortable if not utterly impossible. Similarly, a dip (i.e., a swale) can be equally unpleasant as it torques the back into unusual positions that can cause muscles to spasm.

Campers have long been plagued with uneven sleeping surfaces. There are a variety of reasons that can make any outdoor surface uneven. Outcroppings of roots near or above grade tend to make many surfaces irregular. Similarly, a small rock ledge or boulder outcropping can raise any portion of the grade above that of its surroundings.

Also, certain users may either prefer or require that certain parts of their body be elevated with respect to other parts of their body during sleep. For example, a person with poor circulation in their legs may wish to elevate their legs during sleep. Similarly, a person with GERD (gastro-esophageal reflux disease) will require that their shoulders and head be elevated above their abdomen during sleep to prevent a potentially serious aspiration of gastric fluid from occurring.

There has heretofore been no known way to compensate for an uneven surface with a camping pad and level a sleeping bag when car camping, backpacking, or mountain camping, etc, when the sleeping bag is placed atop the camping pad and the camping pad is placed on the ground, on a liner that is placed on the ground, or on a tent floor that is placed on the ground (or on a liner) if the surface is uneven (i.e., if the surface includes a root outcropping, rock outcropping swell, swale, or other type of obstruction disposed anywhere under the camping pad).

Accordingly, there are two general situations that affect the quality of the surface under a sleeping bag. The first, as mentioned above is incline. Generally, a level surface is usually preferred but as mentioned above certain users may either prefer or require that some portion of their bed (i.e., their sleeping bag when camping) be elevated with respect to other parts of their bed.

The second issue involves uneven (not planar) surfaces. Sometimes these conditions can occur individually and sometimes they occur together, for example, when the surface is both inclined and irregular.

Accordingly, there exists today a need for a leveling camping pad that helps ameliorate the above-mentioned problems and difficulties.

Clearly, such an apparatus would be a useful and desirable device.

2. Description of Prior Art

Camping pads are, in general, known. Air mattresses are, in general, known. Foam core types of inflatable mattresses are also, in general, known certain of which have been manufactured under the "THERMAREST" brand name for an extended period of time. Additionally, the following patents describe various types of these and other distally related devices:

U.S. Pat. No. 6,763,540 to Wang, that issued on Jul. 20, 2004;

U.S. Pat. No. 6,463,610 to Shulte, et al. that issued, Oct. 15, 2002;

U.S. Pat. No. 6,397,419 to Mechache that issued, Jun. 4, 2002;

U.S. Pat. No. 5,303,435 to Haar et al., that issued, Apr. 19, 1994;

U.S. Pat. No. 5,005,236 to Hutchinson, that issued, Apr. 9, 1991;

U.S. Pat. No. 4,980,936 to Frickland, et al., that issued, Jan. 1, 1991; and

U.S. Pat. No. 4,389,961 to Parish, that issued, Jun. 28, 1983.

While the structural arrangements of the above described devices may, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a leveling camping pad that is used under a sleeping bag.

It is also an important object of the invention to provide a leveling camping pad that is used under bedding.

Another object of the invention is to provide a leveling camping pad that is placed on a ground surface or placed on a liner (i.e., a ground cloth) that is placed on the ground surface.

Still another object of the invention is to provide a leveling camping pad that is placed on a tent floor.

Still yet another object of the invention is to provide a leveling camping pad that includes a plurality of chambers extending along a longitudinal length of the leveling camping pad, and wherein at least two of the plurality of chambers include a first separation between a first quantity of air in a first chamber and a second quantity of air in a second chamber, and wherein the first separation extends across a width of the leveling camping pad, and wherein the width is perpendicular with respect to a longitudinal length of the leveling camping pad, and a second separation between the first quantity of air and the second quantity of air, and wherein the second separation is parallel with the longitudinal length of the leveling camping pad.

Yet another important object of the invention is to provide a leveling camping pad that is adapted to improve sleep of a user that is disposed on the leveling camping pad.

Still yet another important object of the invention is to provide a leveling camping pad that can raise a lower portion of the leveling camping pad with respect to an upper portion of the leveling camping pad along both an X and perpendicular Y axis wherein both the X and the Y axis are parallel with a surface upon which the leveling camping pad is placed.

A first continuing object of the invention is to provide a leveling camping pad that can raise an upper portion of the leveling camping pad with respect to a lower portion of the leveling camping pad.

A second continuing object of the invention is to provide a leveling camping pad that can raise a center portion of the leveling camping pad with respect to a lower portion of the leveling camping pad or with respect to an upper portion of the leveling camping pad.

A third continuing object of the invention is to provide a leveling camping pad that can lower a lower portion of the leveling camping pad with respect to an upper portion of the leveling camping pad.

A fourth continuing object of the invention is to provide a leveling camping pad that can lower an upper portion of the leveling camping pad with respect to a lower portion of the leveling camping pad.

A fifth continuing object of the invention is to provide a leveling camping pad that can lower a center portion of the leveling camping pad with respect to a lower portion of the leveling camping pad or with respect to an upper portion of the leveling camping pad.

A sixth continuing object of the invention is to provide a leveling camping pad that can compensate for an irregularity in a ground surface that is disposed underneath the leveling camping pad and wherein an upper surface of the leveling camping pad does not include the irregularity.

A seventh continuing object of the invention is to provide a leveling camping pad that can compensate for an incline in a ground surface that is disposed underneath the leveling camping pad and wherein an upper surface of the leveling camping pad does not include the incline.

An eighth continuing object of the invention is to provide a leveling camping pad that can provide an incline in an upper surface of the leveling camping pad that an opposite bottom surface does not include.

A ninth continuing object of the invention is to provide a leveling camping pad that includes at least four chambers whose pressure is independently adjustable and wherein the at least four chambers are disposed substantially on a first plane and wherein a first chamber of the four chambers is disposed on a first side of a longitudinal axis that extends along the length of the pad and wherein a second chamber is disposed on an opposite second side of the longitudinal axis, and wherein a third chamber of the four chambers is disposed on the first side of the longitudinal axis and at a different location along the length of the longitudinal axis than is the first chamber, and wherein a fourth chamber of the four chambers is disposed on the second side of the longitudinal axis and at a different location along the length of the longitudinal axis than is the second chamber.

A tenth continuing object of the invention is to provide a leveling camping pad that includes at least four chambers whose pressure is independently adjustable and wherein the at least four chambers are disposed substantially on a first plane and wherein a first chamber of the four chambers is disposed on a first side of a longitudinal axis that extends along the length of the pad and wherein a second chamber is disposed on an opposite second side of the longitudinal axis, and wherein a third chamber of the four chambers is disposed on the first side of the longitudinal axis and at a different location along the length of the longitudinal axis than is the first chamber, and wherein a fourth chamber of the four chambers is disposed on the second side of the longitudinal axis and at a different location along the length of the longitudinal axis than is the second chamber and an upper chamber, and wherein a pressure in the upper chamber is independently adjustable, and wherein the upper chamber is disposed substantially on a second plane and wherein the second plane is disposed above the first plane and wherein the upper chamber extends over the at least four chambers.

An eleventh continuing object of the invention is to provide a leveling camping pad that includes at least four chambers whose pressure is independently adjustable and wherein the at least four chambers are disposed substantially on a first plane and an upper chamber that extends over the four chambers.

A twelfth continuing object of the invention is to provide a leveling camping pad that provides greater amount of thermal insulation.

A thirteenth continuing object of the invention is to provide a leveling camping pad that can raise a lower portion of the leveling camping pad with respect to a remaining portion of the leveling camping pad.

A fourteenth continuing object of the invention is to provide a leveling camping pad that can raise or lower a side portion of the leveling camping pad with respect to a remaining portion of the leveling camping pad.

Briefly, a leveling camping pad that is constructed in accordance with the principles of the present invention has at least four chambers whose pressure is independently adjustable and extending substantially along a first plane. At least two of the four chambers include a first separation between a first quantity of air that is disposed in a first chamber and a second quantity of air that is disposed in a second chamber, and wherein the first separation includes a first dividing seam that extends across a width of the leveling camping pad, and wherein the width is perpendicular with respect to a longitudinal length of the leveling camping pad, and including a second separation between the first quantity of air and the second quantity of air, and wherein the second separation includes a second dividing seam that is parallel with the longitudinal length of the leveling camping pad. According to a preferred embodiment, an upper chamber whose pressure is independently adjustable extends over the four chambers. The four chambers are inflated to a preferred pressure sufficient to overcome surface inclines and/or irregularities thereby providing a level upper surface of the upper chamber and also providing additional thermal insulation between the upper surface of the upper chamber and a ground surface that is disposed under a bottom surface of the four chambers.

DETAILED DESCRIPTION OF THE INVENTION

Figure 1:
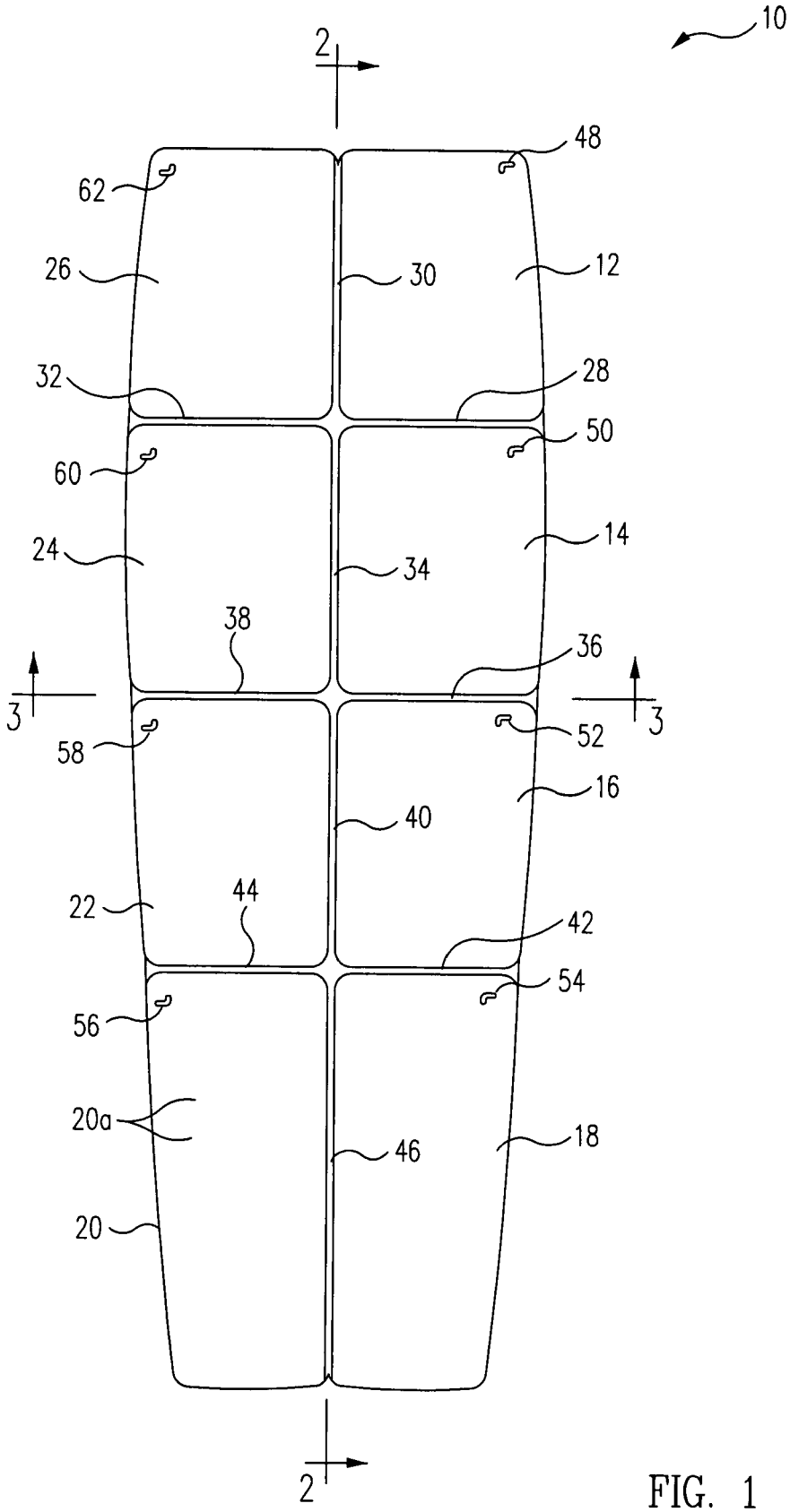
FIG. 1 is a top view of a leveling camping pad.
Figure 2:
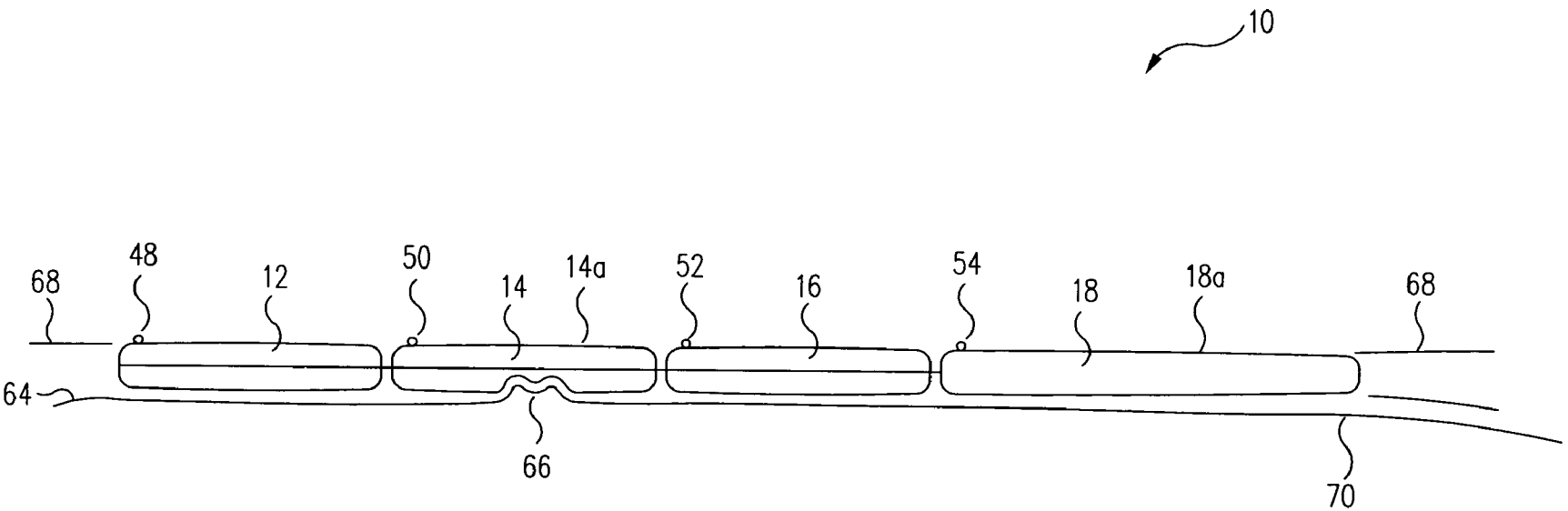
FIG. 2 is a cross sectional view taken on the line 2-2 in FIG. 1 disposed over a longitudinal incline and a surface irregularity.
Figure 3:
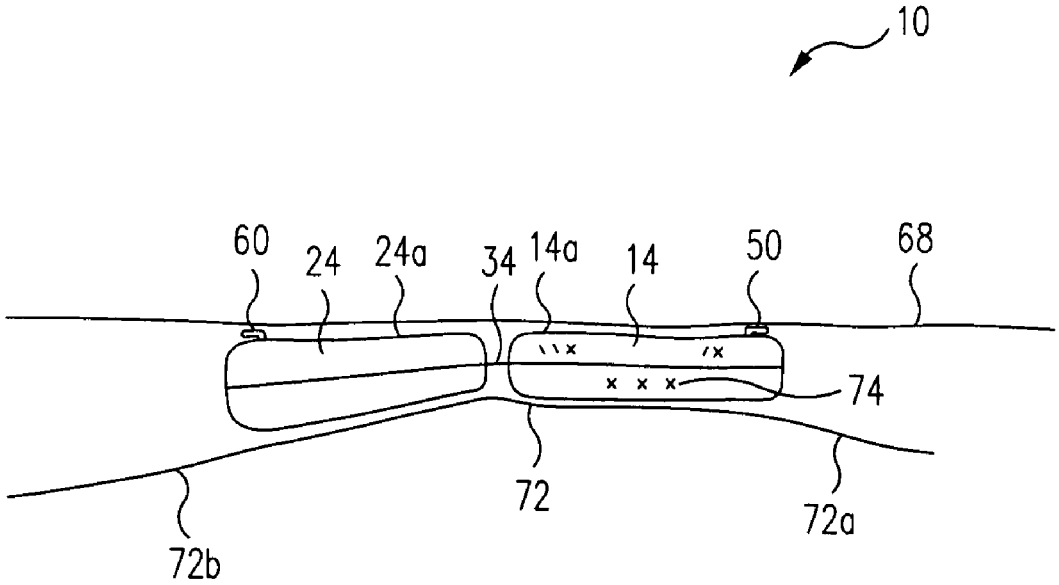
FIG. 3 is a cross sectional view taken on the line 3-3 in FIG. 1 disposed over a lateral incline.

Referring to FIG. 1 and also to FIG. 2 and to FIG. 3 is shown, a leveling camping pad, identified in general by the reference numeral 10.

A plurality of chambers 12-26 are included. The chambers 12-26 include a first chamber 12, a second chamber 14, a third chamber 16, a fourth chamber 18, a fifth chamber 20, a sixth chamber 22, a seventh chamber 24, and an eighth chamber 26 respectively.

The chambers 12-26 are disposed substantially on a first plane and along a longitudinal length (as indicated by line 2-2 in FIG. 1) of the leveling camping pad 10 and on opposite sides of the longitudinal length. A minimum of four chambers are required. Of the minimum a first two chambers must be disposed on opposite sides of the longitudinal length with respect to each other and, additionally, a remaining two chambers must be disposed along the longitudinal length, adjacent to each other, and also adjacent to the first two chambers.

A first separation that includes a first dividing seam 28 is provided between the first chamber 12 and the second chamber 14. The first dividing seam 28 extends laterally across the leveling camping pad 10 in a direction that is generally perpendicular with respect to the longitudinal length thereof.

A second separation that includes a second dividing seam 30 is provided between the first chamber 12 that is disposed on a right side of the longitudinal length and the eighth chamber 26 that is disposed on a side opposite the longitudinal length as that of the first chamber 12.

A third seam 32 is provided between the eighth chamber 26 and the seventh chamber 24.

A fourth seam 34 is provided between the seventh chamber 24 and the second chamber 14.

A fifth seam 36 is provided between the second chamber 14 and the third chamber 16.

A sixth seam 38 is provided between the sixth chamber 22 and the seventh chamber 24.

A seventh seam 40 is provided between the third chamber 16 and the sixth chamber 22.

An eighth seam 42 is provided between the third chamber 16 and the fourth chamber 18.

A ninth seam 44 is provided between the fifth chamber 20 and the sixth chamber 22.

A tenth seam 46 is provided between the fourth chamber 18 and the fifth chamber 20.

Each of the seams 28-46 provides a separation where located that prevents the passage of air (or any other fluid) from any particular chamber to any adjoining chamber.

Air is the most common type of fluid (i.e., gas) that is expected to be used in any of the chambers 12-26.

Accordingly, any flexible material of sufficient durability that is able to retain a quantity of air therein is appropriate for use with the leveling camping pad 10.

A first valve 48 through an eighth valve 62 are each attached to the first chamber 12 to the eighth chamber 26, respectively. The valves 48-62 allow for air to enter into or exit from the chambers 12-26 in accordance with their setting. Any type of the valve 48-62 that is suitable for use can be included.

To fill any chamber 12-26 its corresponding valve 48-62 is opened. If the chambers 12-26 are void of any other substance therein, then the user will inflate each chamber as desired and then close its valve. This is described in greater detail hereinafter. Inflation will commonly be by mouth (at low pressure) or by any preferred type of pneumatic pump. If an open-cell type of foam or other expanding type of filler material, for example goose or duck down or a synthetic fiber fill material is used, then this filler material will allow some or all of the chambers 12-26 to be self-inflating.

Any or all of the chambers 12-26 can include an open-cell, down, or other type of foam or other type of filler material that supplies a normally expansive force to an interior of the chamber that contains it. This is well known in the camping pad art. If such a filler material is used, when the corresponding valve is opened air is able to enter into that chamber which automatically begins to inflate until the filler material has expanded to its maximum amount. At this time, equilibrium between an expansive force inside the chamber and a retentive force by the chamber exists. The chamber then stops drawing outside air into it and stasis regarding the flow of air into (or out of) the chamber is obtained.

The user may then close the valve to that chamber and use it as it is. If a greater size for that chamber is preferred, the user can add additional air to the chamber by blowing into the corresponding open valve and then closing the valve when a sufficient size for the chamber has been attained. If a smaller size for that chamber is preferred, the user can remove some of the air from the chamber by compressing it while the valve is open and then closing the valve when the preferred size for the chamber is attained. This is described in greater detail hereinafter.

This process is repeated for all of the chambers 12-26.

Referring now in particular to FIG. 2, a surface 64 of the ground is shown under the leveling camping pad 10.

A surface irregularity 66 extends above the plane of the surface 64 and bears on a bottom surface of the second chamber 14. The surface irregularity 66 can include a rock, an exposed tree root, or any other object.

The second valve 50 is opened and air is either removed or added into the second chamber 14 so as to dispose an upper surface 14*a* of the second chamber 14 even with an upper level plane 68 of the leveling camping pad 10. The upper level plane 68 is level in all directions.

It is important to note that the surface irregularity 66 does not affect the upper surface 14*a* of the second chamber 14. Accordingly, the upper surface 14*a* is smooth and free of any protrusions. During normal use, a sleeping bag (not shown) is placed atop the leveling camping pad 10. Therefore, the user in the sleeping bag would feel especially comfortable.

It is also important to note that the pressure within the second chamber 14 is regulated so as to dispose the upper surface 14*a* of the second chamber 14 even with the upper surfaces of all of the chambers 12-26, and therefore even with the upper level plane 68.

In this particular instance, the pressure within the second chamber 14 would be slightly reduced (using the second valve 50) from what it would normally be because the surface irregularity 66, which bears into the second chamber 14, tends to increase the pressure therein and therefore tends to elevate the upper surface 14*a* of the second chamber 14 above the upper level plane 68.

Assuming that the first chamber 12 and the eighth chamber 26 are disposed at the head of the sleeping bag and that the fourth chamber 18 and the fifth chamber 20 are disposed at the foot of the sleeping bag, it is noted that the surface 64 of the ground includes an incline 70 that is disposed under the fourth chamber 18 (as shown in FIG. 2) and perhaps also under the fifth chamber 20 (not shown in FIG. 2).

Were it not for the leveling camping pad 10, the sleeping bag would also follow the incline 70 of the surface 64, and also be affected by the surface irregularity 66. Accordingly, the legs and feet of the user would be awkwardly disposed.

Blood would tend to accumulate (i.e., pool) in the feet and legs, which could pose a health concern for some users. For example, pooling blood in the legs may promote the formation of blood clots which can be very dangerous. Therefore, it is desirable to be able to elevate the feet of the user so that they are disposed on (or parallel) with the upper level plane 68.

For example, to level the upper surface 18*a* of the fourth chamber 18, the fourth valve 54 is opened and an additional quantity of air is forced (by mouth, machine, or self-inflating) into the fourth chamber 18 sufficient to dispose an upper surface 18*a* of the fourth chamber 18 even with the upper level plane 68.

Accordingly, the leveling camping pad 10 is adapted to compensate for the incline 70. If a modified type of incline (not shown) included a positive slope (i.e., if the modified incline tended to rise with respect to a remainder of the leveling camping pad 10, air would be removed from the fourth chamber 18, as required, to lower the upper surface 18*a* of the fourth chamber 18 so that it was even with the upper level plane 68.

If the incline 70 or the modified incline extended across the tenth seam 46 and similarly affected the fifth chamber 20, the same steps would be accomplished so that the upper surface 20*a* of the fifth chamber 20 was set to be even with that of the upper level plane 68.

This process is repeated for all of the chambers 12-26. Accordingly the chamber upper surfaces 12*a*-26*a* of each the chambers 12-26 are all disposed on the upper level plane 68. If a swell (not shown) in the surface 64 or the surface irregularity 66 requires less air in any of the chambers 12-26, air is correspondingly removed. If a swale (not shown) in the surface 64 requires that additional air be added in any of the chambers 12-26, an additional quantity of air is added until the chamber upper surfaces 12*a*-26*a* of each the chambers 12-26 are all equal and disposed on the upper level plane 68.

For some users, it is desirable to elevate the feet above the upper level plane 68, for example, to aid in circulation. This is also possible and easy to accomplish with the leveling camping pad 10.

Assuming that the surface 64 was generally level and that it did not include the incline 70 or the modified incline, then an additional quantity of air would be added through the fourth valve 54 and through the fifth valve 56 to further inflate the fourth chamber 18 and the fifth chamber 20 sufficient to raise the upper surface 18*a* of the fourth chamber 18 and the upper surface 20*a* of the fifth chamber above the upper level plane 68, as desired.

Accordingly, it has been shown and described how the upper surfaces 12*a*-26*a* of the leveling camping pad 10 can be adjusted to control their position with respect to the upper level plane 68. In particular, changes in the surface 64 that extend along the longitudinal length of the leveling camping pad 10 are compensated for so as to achieve the desired position for any of the upper surfaces 12*a*-26*a*.

Referring now in particular to FIG. 3, a modified surface 72, as shown in a view taken laterally and extending across the leveling camping pad 10, is provided. The modified surface 72 includes a level portion 72*a* that is disposed under the second chamber 14 and under the first chamber 12.

However, a lateral incline 72*b* in the modified surface 72 is disposed under the seventh chamber 24. An increased amount of air is urged into the seventh chamber 24 so that the upper surface 24*a* of the seventh chamber is level (even) with the upper level plane 68 and therefore with the upper surface (not identified) of the second chamber 14.

Accordingly, the ability to compensate for inclines and uneven surfaces 64, 72 are possible with the leveling camping pad 10. A healthier, more comfortable, and safer rest is provided to the user.

As mentioned hereinbefore, a quantity of an open-cell foam 74 filler material can be included in the second chamber 14 or in any of the remaining chambers 12, 16-26, as desired. The foam 74 can be included in as many of the chambers 12-26, as desired, to provide better insulation as well as to supply a force to help inflate the chambers 12-26.

It is also important to understand that the material used for the leveling camping pad 10, is both flexible and expandable, such as is common with elastomers that do not contain a size-limiting fabric thereto. With certain of the prior art inflatable mattresses that are designed specifically for use in indoor sleeping situations (not shown), two chambers that are separated longitudinally are included. The two chambers extend the entire longitudinal length of the air mattress and are separately inflatable to control pressure and therefore to regulate the firmness of the mattress.

The material used to make such a mattress is also flexible but must be limited as to its maximum size. If the material used was not so limited, a person desiring a firmer sleep would inflate their side to a higher pressure than that of their partner's which would then cause their side to expand and rise above that of their partner's. This is not practical.

However, the instant invention specifically teaches the expansion of the width of any of the chambers 12-26 to compensate for inclines and surface irregularities and also to provide elevated surfaces, for example, at the foot of the leveling camping pad 10 to aid in circulation. Accordingly, the instant invention teaches away from the known prior art. This is described in greater detail below.

The chambers 12-26 of the instant invention are not intended to solve issues of firmness but rather to provide a level (or otherwise controlled) upper surface and to compensate for inclines and surface irregularities or specific medical conditions that require elevated surfaces. It is not practical for a person who requires his feet or his esophagus to be elevated to transport any additional method for doing so when camping or backpacking due to size and weight portage limitations.

For this new capability to occur, each of the chambers 12-26 of the instant invention must stretch and expand across its thickness (preferably not substantially in length or width) depending on the pressure that is in each individual chamber 12-26.

Also, the positioning of the chambers 12-26 of the instant invention is crucial because the positioning allows for proper compensation of surface irregularities and inclines wherever they may be disposed under the leveling camping pad 10 to occur. Therefore, being able to adjust the thickness of certain of the chambers 12-26 along the longitudinal length of the leveling camping pad 10 and also laterally on either side of a center longitudinal axis (same as line 2-2 of FIG. 1) of the leveling camping pad 10 is the only way to adequately compensate for a variety of surface irregularities and inclines sufficient to provide the leveling camping pad 10.

It is important to note that the inclines may occur in any direction, laterally across the leveling camping pad 10, along its longitudinal length, diagonally across the leveling camping pad 10, or any combination thereof.

As this problem has not heretofore been satisfactorily addressed, there has been no prior solution that can provide a level upper surface that can compensate for an uneven ground surface 70, 72, 66.

Figure 4:
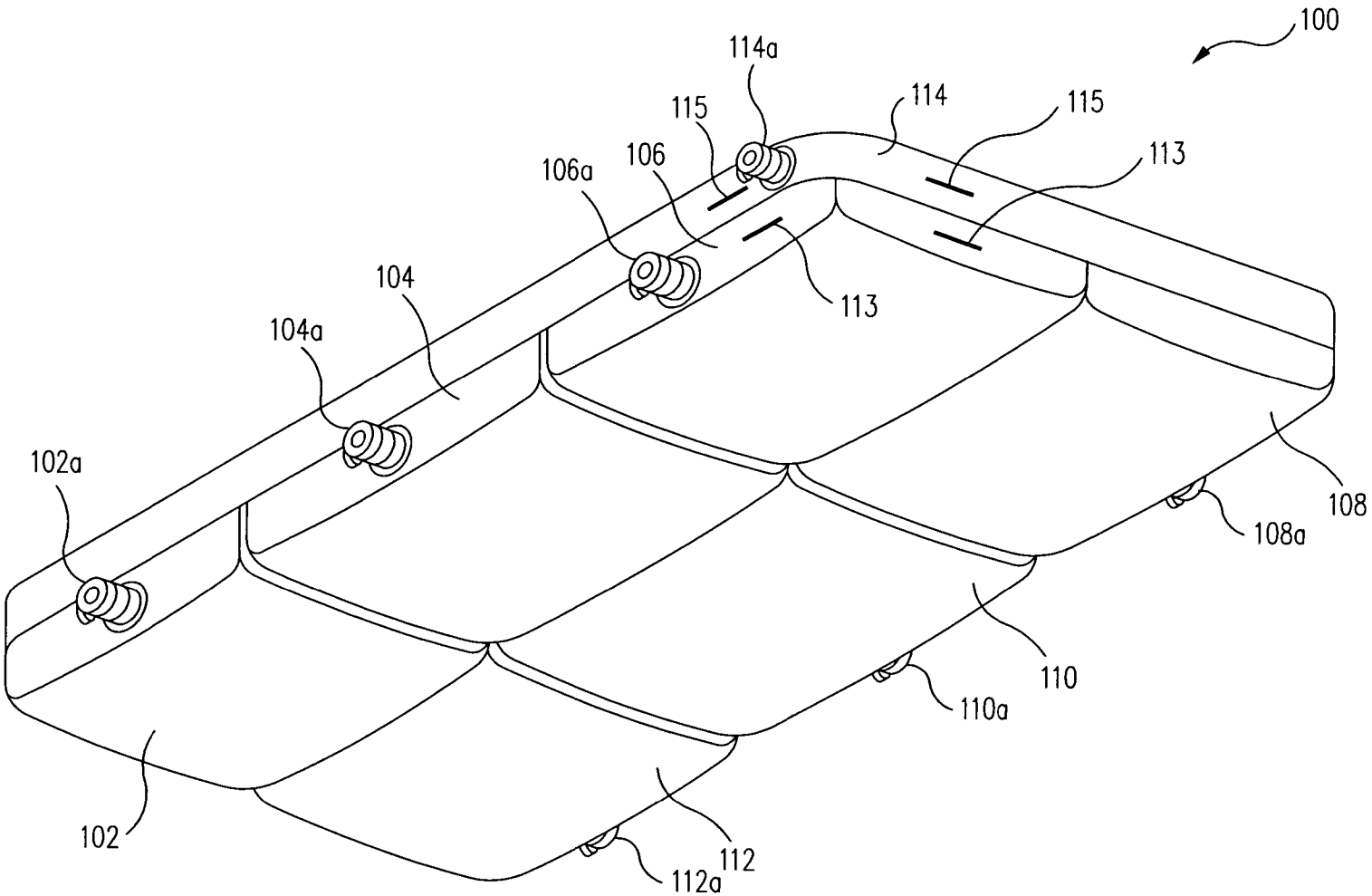
FIG. 4 is a view in perspective of a modified leveling camping pad with an upper chamber attached thereto.

Referring now to FIG. 4, a preferred form of the instant invention is shown as a modified leveling camping pad, identified in general by the reference numeral 100. The view is a perspective view taken from a position somewhat underneath the modified leveling camping pad 100.

The modified leveling camping pad 100, as shown, includes a generally rectangular overall shape, however, that is only to illustrate a preferred shape for many applications. Any overall shape is possible for the modified leveling camping pad 100 or for any version of the leveling camping pad 10, as desired.

A modified first chamber 102, a modified second chamber 104, a modified third chamber 106, a modified fourth chamber 108, a modified fifth chamber 110, and a modified sixth chamber 112 are similar to that as previously described for the leveling camping pad 10. The modified chambers 102-112 are disposed on top of a ground surface (not shown in FIG. 4).

While a minimum of four chambers (of the modified chambers 102-112) are required to provide the benefits of the instant invention, the use of six chambers is generally preferred for the modified leveling camping pad 100 and also for the leveling camping pad 10. Of course, any number of chambers equal to or greater than four (total) can be used, as previously mentioned.

Each of the modified chambers 102-112 includes a corresponding valve **102*a*-112*a* for individually adjusting a pressure therein. When inflated, a center of each of the modified chambers 102-112 is substantially disposed along a first plane 113 (if the modified chambers 102-111 include the same pressure therein and if they are placed on a level surface). The first plane 113 is indicated by a pair of lines disposed on adjacent corners of the third modified chamber 106 and which are parallel to each other and extend similarly through the remaining modified chambers 102, 104, 108-112**.

The pressure within each of the modified chambers 102-112 is varied, as previously described for the leveling camping pad 10, to compensate for inclines and/or the surface irregularity 66.

Attached to an upper surface of the modified chambers 102-112 and extending over each of the modified chambers 102-112 is an upper chamber 114. An upper chamber fill valve **114*a* is used to regulate the pressure within the upper chamber 114**.

The upper chamber 114 may or may not include any type of filler, as desired. If preferred, the upper chamber 114 can include an open-cell foam, down, or other filler material, for example a synthetic fiber fill material, or if preferred it can be void of all filler materials. The modified chambers 102-112 can also include any type of filler, if desired.

The upper chamber 114 is similar to a conventional prior art type of camping pad.

The upper chamber 114 is filled, either by self-expansion caused by an expansive filler material disposed therein, or by mouth (or pump), or initially to a first pressure by the filler material and then adjusted to a second pressure, as desired, thereafter by mouth or pump (to increase the pressure therein in order to provide a firmer surface upon which to sleep) or by forcing air out of the upper chamber 114 (to decrease the pressure therein in order to provide a softer surface upon which to sleep).

The modified leveling camping pad 100 is then placed on the ground with the modified chambers 102-112 in contact with the ground surface. Each of the modified chambers 102-112 is then filled to a desired degree to compensate for inclines on the ground surface sufficient to dispose a center of the upper chamber 114 along its entire length and width on a level second plane 115.

The first plane 113 of each of the modified chambers 102-112 may then be parallel to one another or they may be raised or lowered with respect to each other, or they may be at different angles with respect to each other depending upon the contour and irregularities of the surface upon which the modified leveling camping pad 100 is placed.

Each of the modified chambers 102-112, as previously mentioned, can include any desired filler material, including expansive filler materials such as open-cell foam or down or a synthetic fiber fill material, or they may be void of any filler material.

For certain applications, it is preferred to include an open-cell foam or down or another type of expansive filler material such as a synthetic fiber fill material in the upper chamber 114 (for added insulation) and not in the modified chambers 102-112.

The second plane 115 is indicated by a pair of perpendicular lines disposed on adjacent corners of the upper chamber 114 and which are parallel to each other and which extend through a remainder of the upper chamber 114. The first plane 113 and the second plane 115 are inherent attributes of the modified leveling camping pad 100. They are not normally included as visible indications on the modified leveling camping pad 100.

The first plane 113 and the second plane 115 are generally parallel with respect to each other and are disposed in a spaced-apart relationship with respect to each other. Of course, the first plane 113 can vary somewhat, as previously mentioned, in accordance with the surface upon which the modified leveling camping pad 100 is placed.

In use, a sleeping bag (not shown) would be placed atop the upper chamber 114 after the second plane 115 has been leveled and the proper air pressure (for sleep firmness) has been ideally set. The modified leveling camping pad 100 provides additional advantages and benefits over the leveling camping pad 10 and is generally preferred whenever possible. A principal disadvantage the modified leveling camping pad 100 has when compared to the leveling camping pad 10 is that it weighs slightly more. For the back-country camper who must keep weight to an absolute minimum, while either version is suitable, the lighter leveling camping pad 10 may be preferred.

The modified leveling camping pad 100 provides a smooth surface (i.e., the top of the upper chamber 114) devoid of all seams. Accordingly, it is more comfortable to sleep on.

The modified chambers 102-112 also provide a first level of thermal insulation from the ground, similar to that of the leveling camping pad 10. The upper chamber 114 provides a second additional layer of thermal insulation that, together with the thermal insulation that is provided by the modified chambers 102-112, provides for a very comfortable night's sleep. The person using the modified leveling camping pad 100 saves body energy. This can allow the consumption of less food and can, in emergency situations, allow for a longer survival period than would otherwise be possible.

Because each of the modified chambers 102-112 is separate and incapable of sharing fluid (i.e., air) with the upper chamber 114, thermal transfer through the modified chambers 102-112 and with the upper chamber 114 is greatly reduced.

While the size of any aspect of the instant invention 10, 100 can be varied as desired, a preferred thickness range for the chambers 12-26 or for the modified chambers 102-112, when inflated, is from about 1 inch thick to about 2.5 inches thick, depending on the pressure therein.

A preferred thickness for the upper chamber 114 when inflated is approximately one and one-half inches thick. Therefore, a preferred total thickness will range from about two and one-half to about four inches thick, when inflated.

Other modifications for the modified leveling camping pad 100 are of course, possible. For example, if weight is less of an issue and either comfort or further increasing thermal resistance are desired, then an additional layer of closed-cell foam (not shown) can be added where desired, for example, the additional layer of closed-cell foam can be disposed between the modified chambers 102-112 and the upper chamber 114.

Alternately the additional layer of closed-cell foam can be placed atop the upper chamber 114 or, if desired, below the modified chambers 102-112. Similar additions and other changes are also possible for use with the leveling camping pad 10.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. An improvement to an inflatable camping pad of the type that includes a width and a longitudinal length and wherein the length is greater than the width and wherein the width is perpendicular with respect to the length, the improvement comprising:

(a) at least four chambers that are each separately inflatable with respect to each other and wherein each of said at least four chambers is able to be separately deflated with respect to a remainder thereof, and wherein at least two of said at least four chambers are disposed at a different position along the longitudinal length with respect to each other and wherein a remaining one of said at least four chambers is disposed at a different position along the width of the camping pad with respect to either of said two of said four chambers, and wherein each of said at least four chambers are adapted for placement on a surface, and wherein each of said at least four chambers are disposed on a first lower level; and (b) an inflatable upper chamber that is disposed over the first lower level and attached to said at least four chambers, and wherein the upper chamber extends over all of said at least four chambers and wherein said inflatable upper chamber is able to be separately inflated or separately deflated with respect to each of said at least four chambers, and wherein said upper chamber does not include a plurality of chambers therein.

2. The improvement to an inflatable camping pad of claim 1 wherein at least one of the chambers includes a substance that is adapted to expand or contract therein.

3. The improvement to an inflatable camping pad of claim 2 wherein the substance includes an open-cell foam.

4. The improvement to an inflatable camping pad of claim 2 wherein the substance is selected from the group consisting of: goose down, duck down, and synthetic fibers.

5. The improvement to an inflatable camping pad of claim 1 including a valve that is attached to each of said four chambers.

6. A leveling camping pad, comprising:

(a) at least four chambers that are each separately inflatable with respect to each other and where said at least four chambers are each separately able to be deflated with respect to each other, and wherein two of said four chambers are disposed at a different position along a longitudinal length of the camping pad with respect to each other and wherein a remaining one of said at least four chambers is disposed at a different position along a width of the camping pad with respect to either of said two of said at least four chambers, and wherein the width is perpendicular with respect to the length, and wherein each of said at least four chambers are adapted for placement on a surface, and wherein each of said at least four chambers are disposed on a first lower level;

(b) means for adding a fluid into a first of said at least four chambers that does not affect a quantity of fluid in any of a remainder of said at least four chambers; and (c) an inflatable upper chamber that is disposed over the first lower level and attached to said at least four chambers and wherein the upper chamber extends over all of said at least four chambers and wherein said inflatable upper chamber is able to be separately inflated or deflated with respect to each of said at least four chambers, and wherein said upper chamber does not include a plurality of chambers therein.

7. The leveling camping pad of claim 6 wherein said means for adding a fluid includes means for adding a fluid into a remainder of said at least four chambers that does not affect a quantity of said fluid remaining in any of said at least four chambers.

8. The leveling camping pad of claim 6 wherein said means for adding a fluid includes means for removing said fluid.

9. The leveling camping pad of claim 8 wherein said means for adding a fluid and said means for removing said fluid includes a valve that is attached to said first of said at least four chambers.

10. The leveling camping pad of claim 6 wherein said fluid includes a gas.

11. The leveling camping pad of claim 10 wherein said gas includes air.

12. An improvement to an inflatable camping pad, wherein the improvement comprises:

(a) means for varying a distance a top surface of each of at least four separately inflatable chambers is disposed above a ground surface that is disposed on an opposite side of said camping pad with respect to the top surface thereof, and wherein at least two of said at least four chambers are disposed at a different position along a longitudinal length of the camping pad with respect to each other and wherein at least a remaining one of said at least four chambers is disposed at a different position along a width of the camping pad with respect to either of said two of said at least four chambers, and wherein the width is perpendicular with respect to the length;

(b) wherein each of said at least four separately inflatable chambers is able to separately deflated with respect to a remainder of said at least four separately inflatable chambers, and wherein said at least four separately inflatable chambers are disposed on a lower level, and wherein a bottom surface of each of said at least four separately inflatable chambers is adapted for placement on said ground surface; and (c) an inflatable upper chamber that is disposed over the first lower level and attached to said top surface of each of said at least four separately inflatable chambers, and wherein the upper chamber extends over all of said at least four separately inflatable chambers and wherein said inflatable upper chamber is able to be separately inflated or deflated with respect to each of said at least four separately inflatable chambers, and wherein said upper chamber does not include a plurality of chambers therein.

13. The improvement of claim 12 wherein said means for varying a distance includes means for leveling said top surface sufficient to compensate for an incline that is disposed under the camping pad.

14. The improvement of claim 12 wherein said means for varying a distance includes means for leveling said top surface sufficient to compensate for surface irregularity that is disposed under the camping pad.

* * * * *